US010471453B2

(12) United States Patent
Saravia Castillón

(10) Patent No.: US 10,471,453 B2
(45) Date of Patent: Nov. 12, 2019

(54) PUMP SUCTION/EXPULSION FOR LIQUIDS AND GASES VERSATILE

(76) Inventor: Carlos Saravia Castillón, Durango (MX)

( * ) Notice: Subject to any disclaimer, the term of this patent is extended or adjusted under 35 U.S.C. 154(b) by 769 days.

(21) Appl. No.: 14/382,542

(22) PCT Filed: Apr. 2, 2012

(86) PCT No.: PCT/MX2012/000036

§ 371 (c)(1),
(2), (4) Date: Apr. 21, 2015

(87) PCT Pub. No.: WO2013/151409

PCT Pub. Date: Oct. 10, 2013

(65) Prior Publication Data

US 2015/0231656 A1 Aug. 20, 2015

(51) Int. Cl.

| | |
|---|---|
| ***F04B 9/14*** | (2006.01) |
| ***B05B 11/00*** | (2006.01) |
| ***B05C 17/03*** | (2006.01) |
| ***F04B 9/02*** | (2006.01) |
| ***F04B 33/00*** | (2006.01) |
| ***B05B 9/04*** | (2006.01) |
| ***B05B 9/08*** | (2006.01) |
| ***B05B 15/60*** | (2018.01) |
| ***B05B 15/65*** | (2018.01) |
| ***F04B 9/04*** | (2006.01) |
| ***F04B 23/02*** | (2006.01) |
| ***F04B 35/01*** | (2006.01) |
| ***F04B 39/08*** | (2006.01) |
| ***F04B 39/12*** | (2006.01) |
| ***F04B 41/02*** | (2006.01) |

(52) U.S. Cl.

CPC ..... *B05B 11/30* (2013.01); *B05B 9/0426* (2013.01); *B05B 9/085* (2013.01); *B05B 15/60* (2018.02); *B05B 15/65* (2018.02); *B05C 17/0333* (2013.01); *F04B 9/02* (2013.01); *F04B 9/042* (2013.01); *F04B 9/14* (2013.01); *F04B 23/02* (2013.01); *F04B 33/00* (2013.01); *F04B 35/01* (2013.01); *F04B 39/08* (2013.01); *F04B 39/12* (2013.01); *F04B 41/02* (2013.01)

(58) Field of Classification Search

CPC ..... F04B 15/00; F04B 15/02; B05B 9/0426
See application file for complete search history.

(56) References Cited

U.S. PATENT DOCUMENTS 3,002,699 A * 10/1961 Pinke ..... B05B 11/3015 222/382
4,142,654 A * 3/1979 Doubleday ..... B05B 9/0426 222/309

* cited by examiner

*Primary Examiner* — Patrick Hamo

(57) ABSTRACT

A pump for supplying liquids or gases, comprising: a mechanism of suction/discharge consists of a handle, fasteners and injection pump, a piston, a dispenser, a body of valves, two valves, pump a shirt, a piece containing a pumping chamber, at least two primary and secondary supports, bridge pump with at least two fastening means of conduit and oppressive cam piston articles attachments or pump and tank securing means; a container of liquid or gas should be projected by suction/expulsion; a hose transports.

18 Claims, 12 Drawing Sheets

PUMP SUCTION/EXPULSION FOR LIQUIDS AND GASES VERSATILE

TECHNICAL FIELD OF THE INVENTION

The present invention relates to the technical field of the mechanical, more specifically in the area of hand pumps to deliver fluids or gases, providing a pump to supply water in manually, light painting, oil, fertilizer, insecticide, air for filling tires, balloons, etc.

BACKGROUND OF THE INVENTION

One of the problems that have arisen in the area of hand pumps, is that there is a pump that is versatile, which can exert several activities either to inflator a ball, balloon, tire, to provide light liquids such as water to be used as a pump sprayer or misting up to provide heavy liquids such as paint, is the fact that the paint is thick, viscous and sticky, whose consistency is more like honey; and therefore when dried paste parts and obstructs ducts. Has an unstable chemical that constantly tend to create phlegm, cream and lumps. Although there has been properly filtered, can clog ducts at any time, either while painting, or especially, when left at rest; as insecticides or herbicides are lighter this pump can supply the amount needed to give effect misting or throwing the liquid jet, which is to be applied, that is why existing hand pumps on the market just do a function or at most two functions as throwing fluid or air jet or spray, but are limited to misting or heavy liquids or you need to have an electrical system to throw hard and liquid.

In order to eliminate all the aforementioned drawbacks, some novel improvements to a mechanism for throwing fluids or gases including means for supplying efficiently developed in addition to a major emphasis on versatility of uses and in the same washing is done. This invention allows the delivery of liquids or gases, with an easy and continuous flow, plus it has a fastening system objects in the same body that allows in some situations adhere or couple it, a roller and/or understandable handle with which through a hose supplying the liquid or gas and thus have better support, which I describe below.

DISCLOSURE OF THE INVENTION

Figure 1:
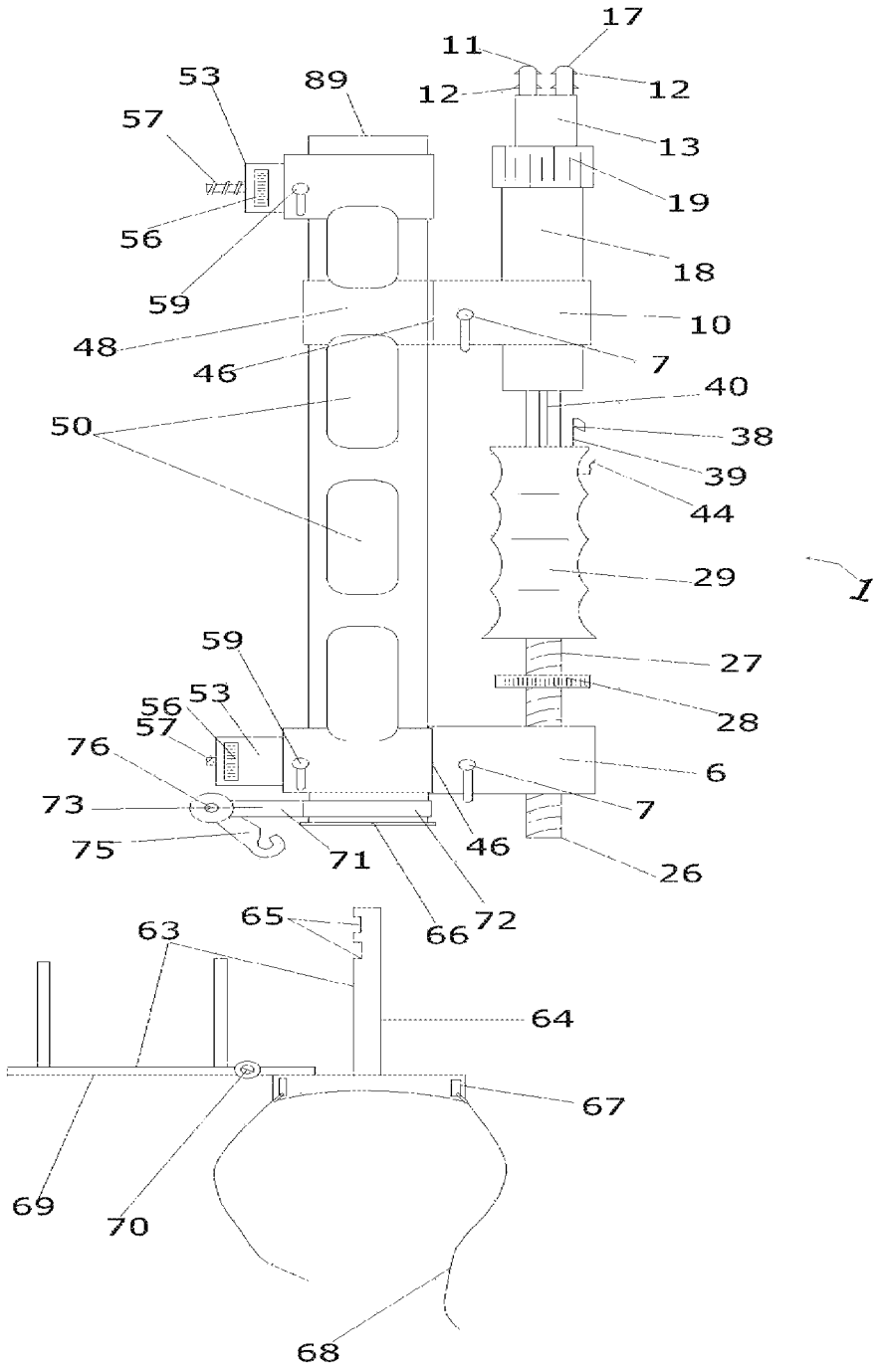
FIG. 1 is a side view of the pump with the bridge of the pump and its fastening system T.
Figure 2:
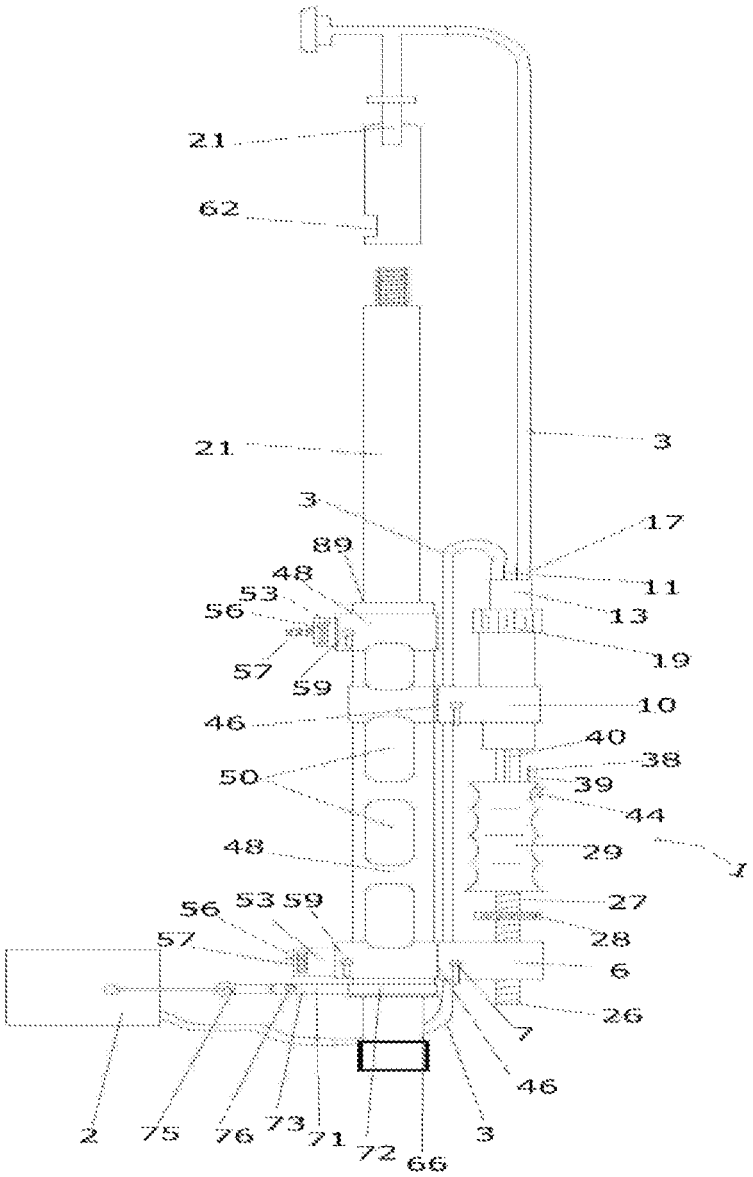
FIG. 2 is a side view of the pump with the bridge with integrated pump attachments.
Figure 3:
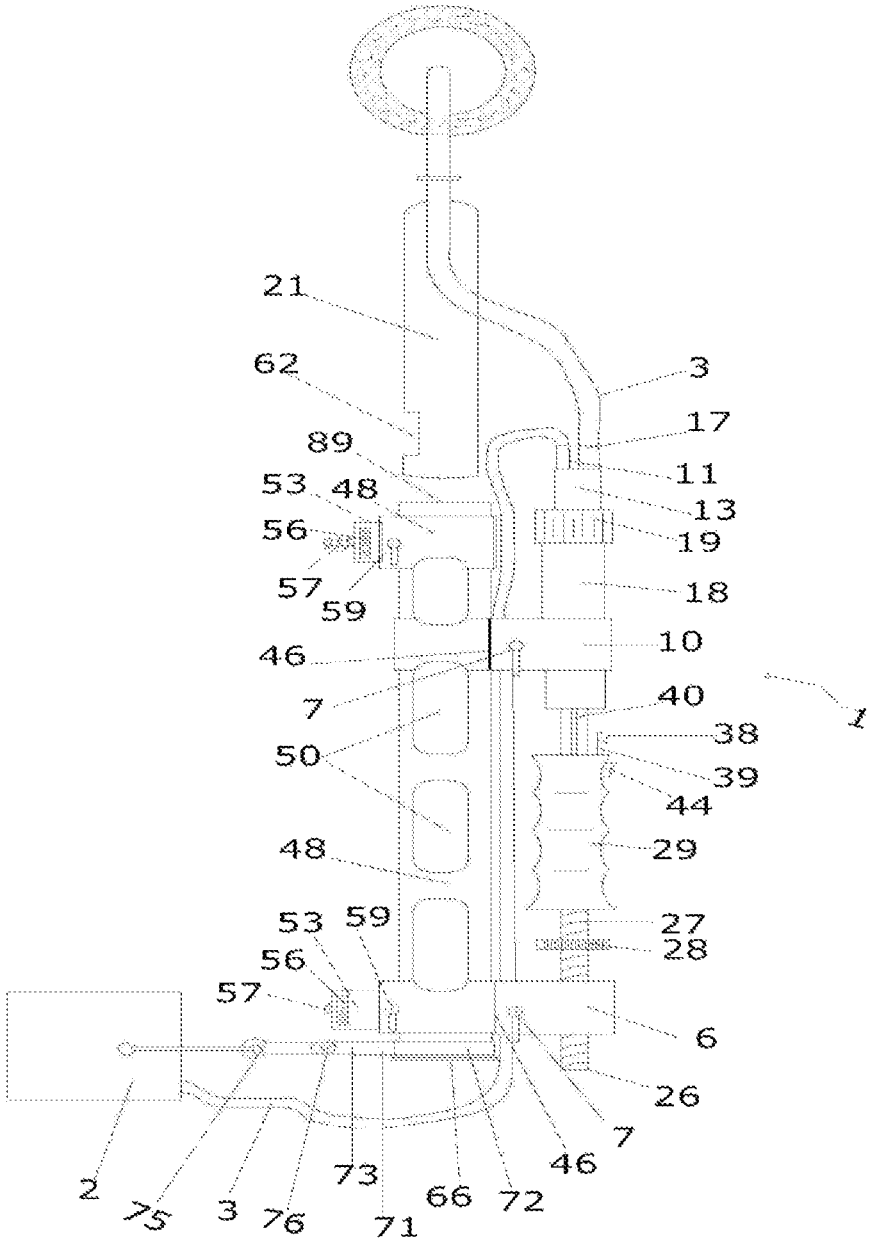
FIG. 3 is a side view of the pump with the bridge of the pump and an attachment that is a roller.
Figure 4:
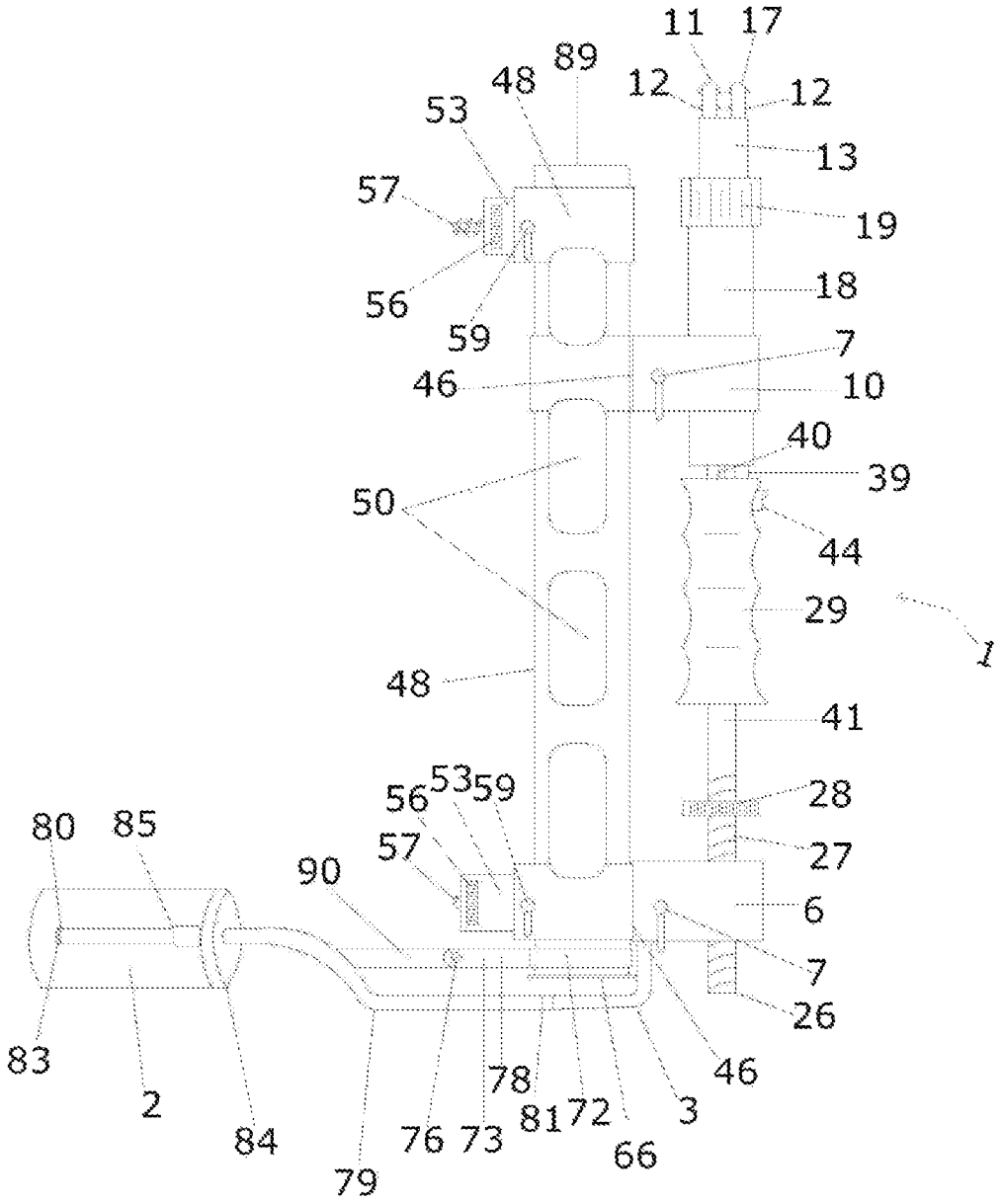
FIG. 4 is a side view of the pump with the bridge of the clamping system pump container and screw in the lid.
Figure 5:
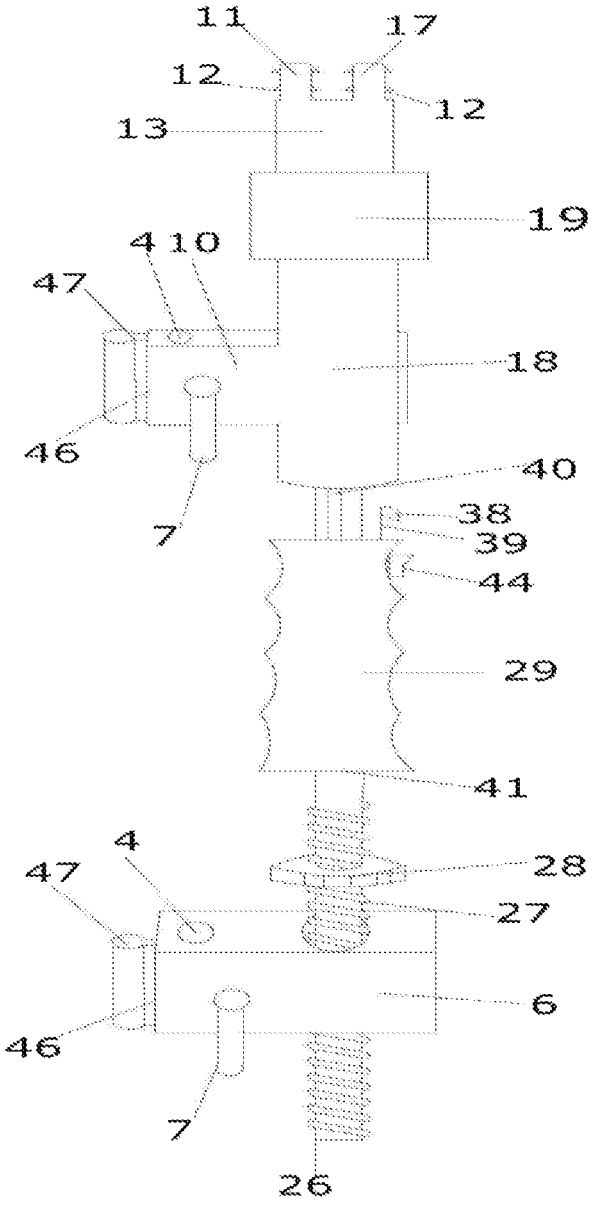
FIG. 5 is a side view of the mechanism for suction/discharge of the pump.
Figure 6:
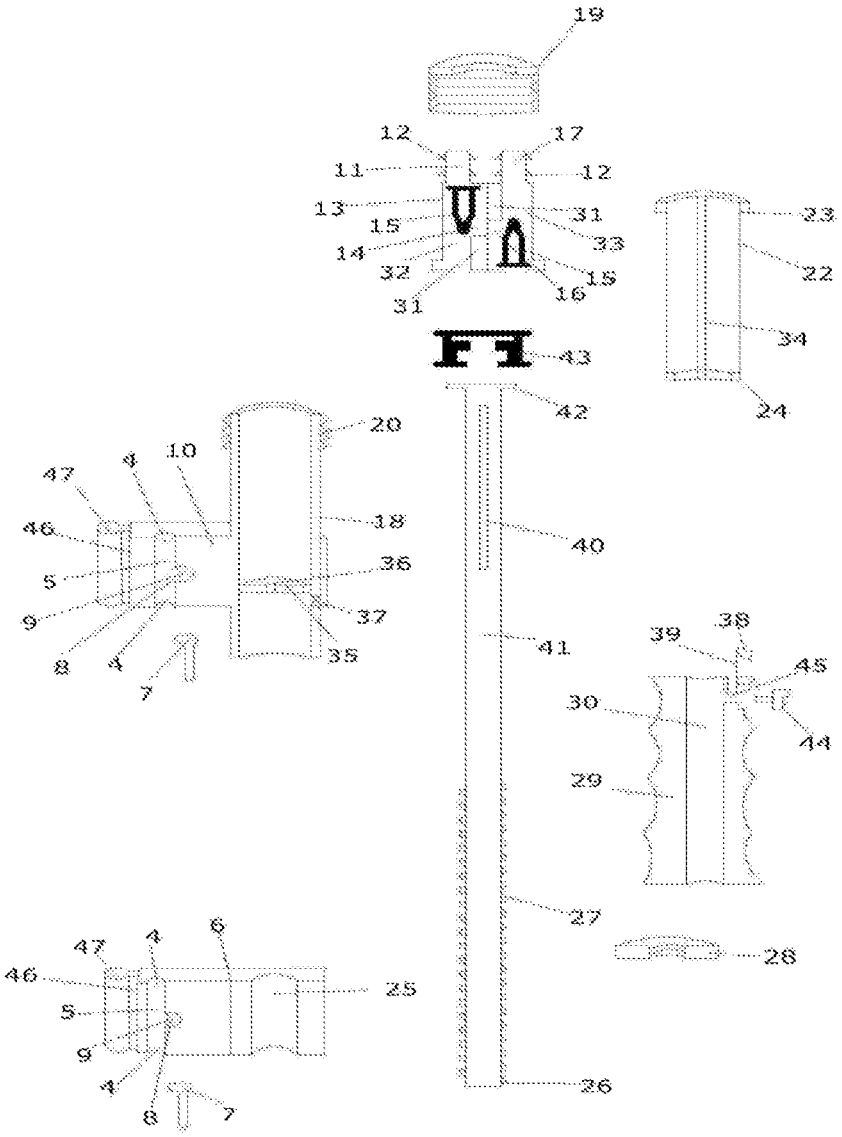
FIG. 6 is an explosive view of a longitudinal section of the pump components.
Figure 7:
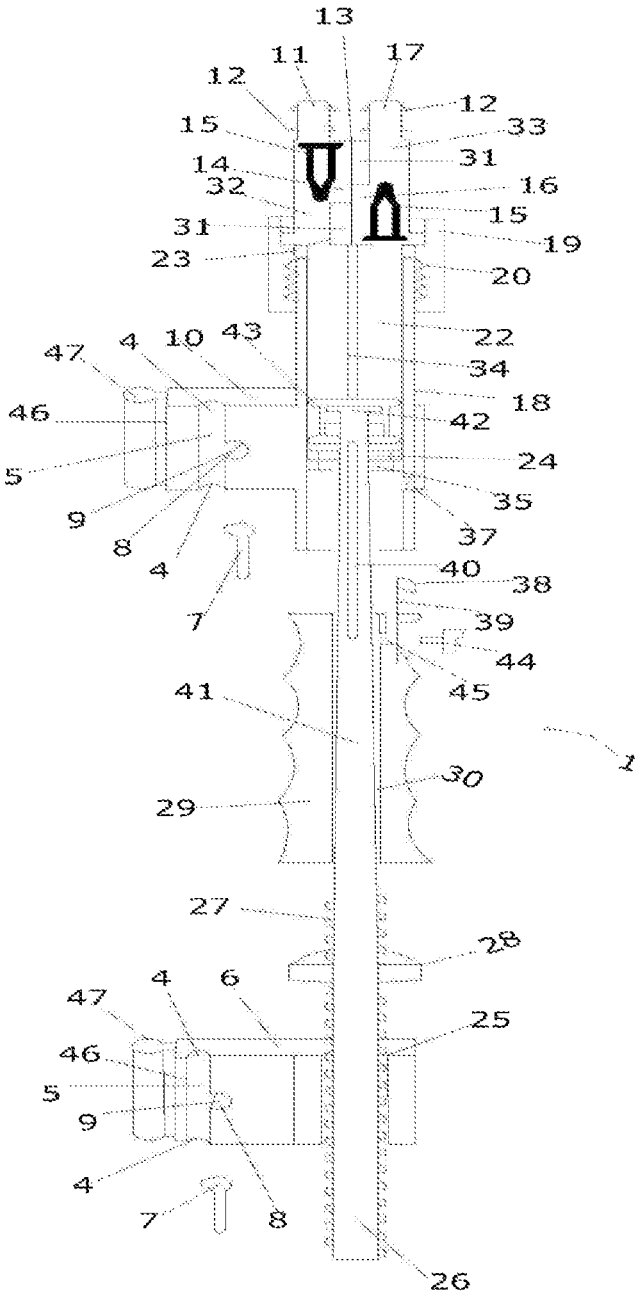
FIG. 7 is a longitudinal sectional view of a mechanism of suction/discharge.
Figure 8:
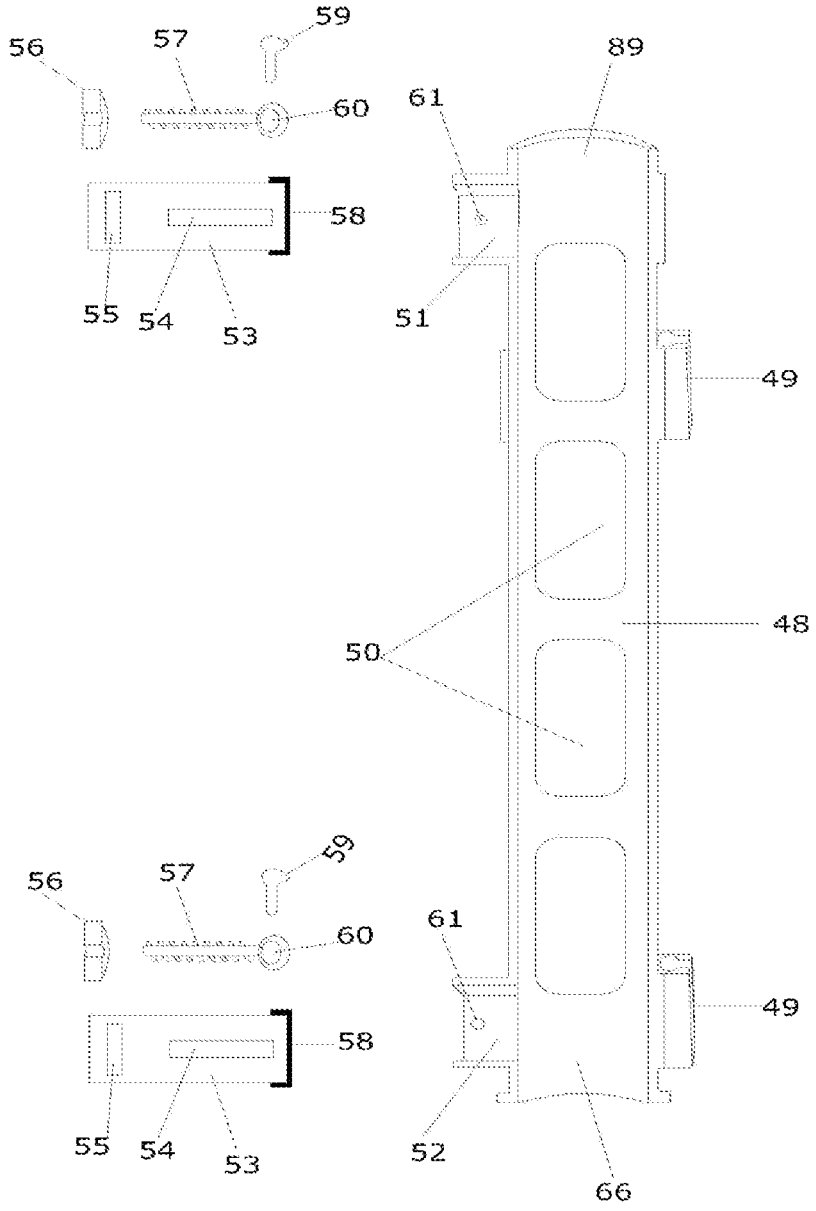
FIG. 8 is a longitudinal sectional view of a pump Bridge.
Figure 8A:
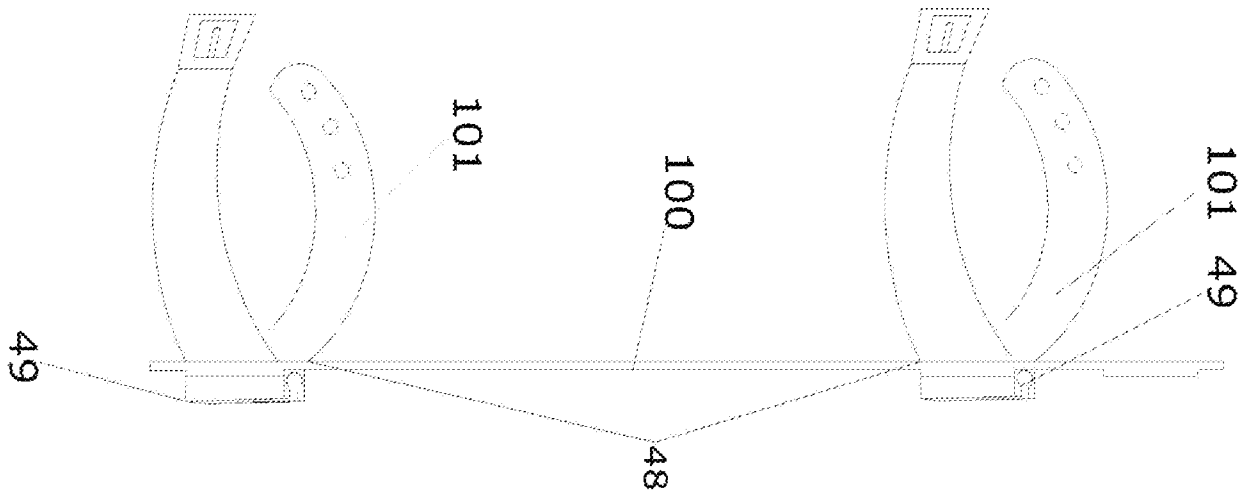
FIG. 8A is a perspective view of one embodiment of the bridge of the pump.
Figure 10:
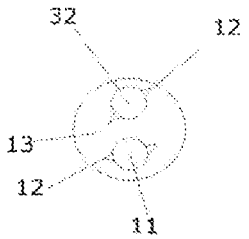
FIG. 10 is a front view of the part valve body named without union nut.
Figure 9:
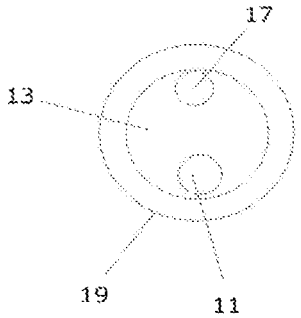
FIG. 9 is a front view of the valve body.
Figure 12:
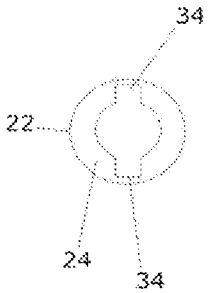
FIG. 12 is a frontal view of the piece called internal container.
Figure 11:
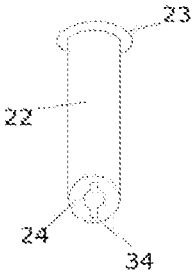
FIG. 11 is a perspective view of the piece called internal container.
Figure 13:
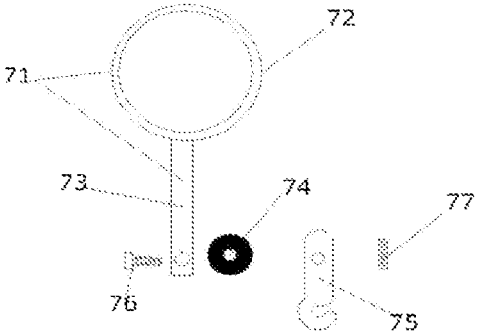
FIG. 13 is an explosive view of the parts that make up the fastening system with container hook.
Figure 14:
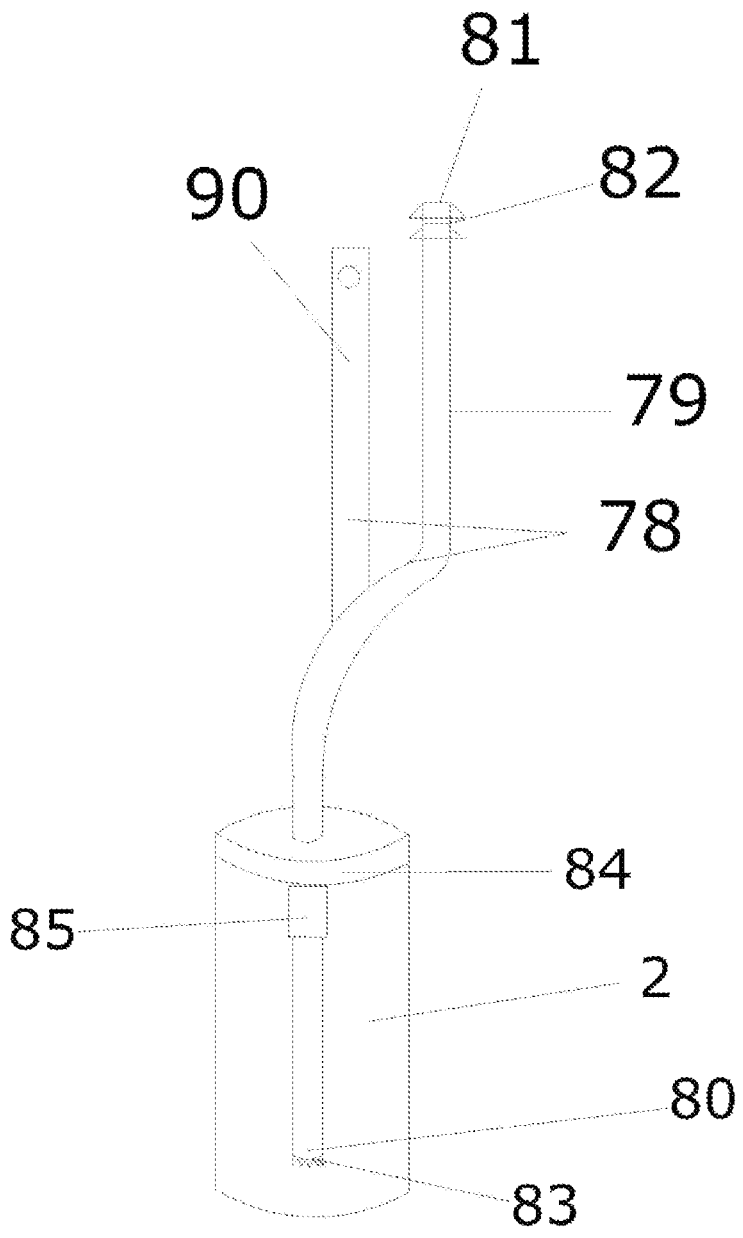
FIG. 14 is a perspective view of an embodiment of the clamping system with setscrew container below the container lid.
Figure 15:
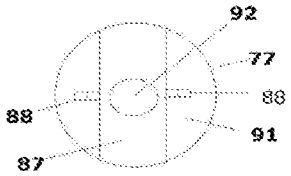
FIG. 15 is a top view of the set screw of the fastening system of the container with lid.
Figure 16:
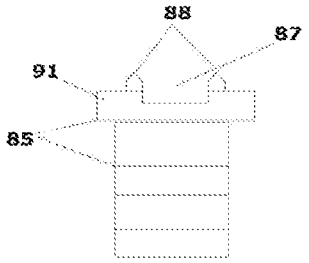
FIG. 16 is a side view of the set screw inserted into the oppressive nut with tapered end.
Figure 17:
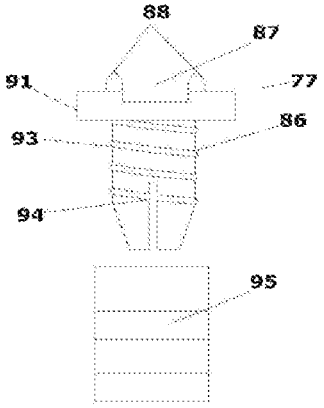
FIG. 17 is an explosive view of the two pieces that make up the set screw.
Figure 18:
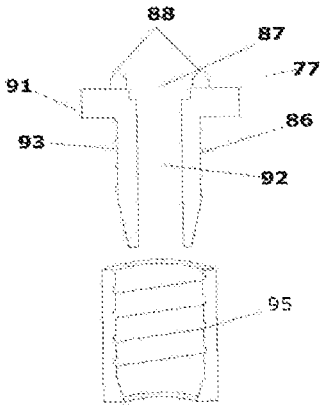
FIG. 18 is a view of a longitudinal section of FIG. 17.
Figure 19:
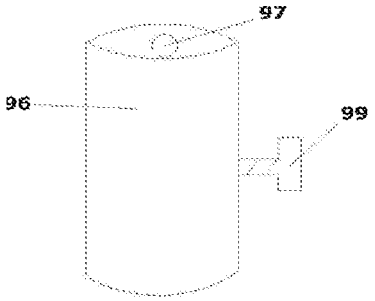
FIG. 19 is a perspective view of an embodiment of tube oppressive.
Figure 20:
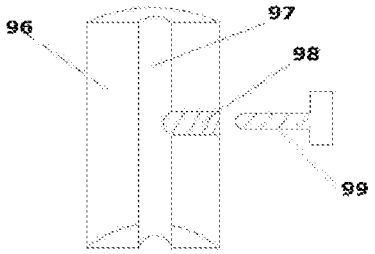
FIG. 20 is a view of a longitudinal section of FIG. 19.

The characteristic details of the present invention that include means for delivering liquids or gases efficiently, are described below and based on the figures mentioned by way of example, so that they should not be regarded as limiting.

As seen in the figures, the construction of the pump of the present invention comprises mainly a mechanism suction/discharge (1) for delivering liquids or gases; a container (2) manufactured in one piece which is intended to contain liquid or product should be projected through suction/discharge to a hose (3) that carries the product of any material, said hose (3) is chemically resistant to chemicals and gases corrosion. The hose (3) is inserted through a hole (4) having a lower passed duct (5) located in the bottom of a primary fastening bracket (6) of the mechanism body (1), same hose (3) is pressed inwardly by a pressure cam (7); said cam is positioned within a bore (8) with upper passed duct (9), which is a few millimeters higher than the passed duct (5), but these two ducts (5 and 9) are between crossing internally and serve as guide the hose (3) to be pressed by the cam (7) and thus push the flow of material transported internally by the hose (3); that mechanism (1) has a secondary clamp bracket (10) in its lower part, where the hose (3) will pass to be connected to an entry nozzle (11) of liquids or gases, this nozzle (11) is a tube in its outer part has some small subjection protrusions (12) already known it by one skilled in the art, that serve as gripper pressure of the hose (3); said nozzle (11) is integrated in one piece, preferably circular called valve body (13) having two cylindrical internal cavities, one inlet (14) and an output (16), which also include two small protrusions (31) serving to thin output cavities (32 and 33), thereby allowing for which when inserted, at least, a pair of inverted duckbill valves, metallic pellet, membrane or any other type of valve (15), they have only a limit inward movement, and the flow of liquids or gases, exerts a higher internal pressure, being vented to the outlet nozzle (17), which will engage another length of hose (3) that serve to mate with any other mechanism (21) such as a brush, roller, spray liquid, nebulizer or a pivot for inflating tires, balls, balloons, etc.

The valve body (13) is coupled to an elongated piece of tubular shape and internally passed called inner container (22) that is where the liquid or gas are deposited to be ejected from the mechanism of suction/discharge (1), said inner container (22) has at its left end a circular salient (23) on the outside and the other right end has a circular salient (24), plus two internal channels (34) that run throughout the body internal of the inner container (22). Subsequently it will be inserted into a pumping chamber (18), which is a cylindrical body and in its internal part is smooth and slightly larger than the inner container (22). The pumping chamber (18) has a circular salient (35) with two slots (36) of the same size internal channels (34) of the inner container (22), said circular salient (35) is more located at the right of cylindrical body of the pumping chamber (18) which will first function limit and coupling the inner container (22) by its right end, and as a second function is limiting the sliding of a piston (26); at the top inside of the cylindrical body of the pumping chamber (18) there is a small cavity (37), which serve to accommodate a metal tip or any material (38) of the insurance fastening's lamella (39) of an ergonomic handle (29); on the left side of the pumping chamber (18), in its body's outer part has a threaded section (20), wherein the valve body (13) will be coupled, both parts will be subjected to pressure by a union nut (19) in order to join these two parts and liquid or gas no exhaust; in the lower right part of the pumping chamber (18) projects a section which forms the secondary bracket (10) which has a hole (4, 8), ducts (5 and 9), and a cam (7), all identical to those described in the primary bracket (6).

The piston (26) of the body of the mechanism (1) is made of a single cylindrical piece or can change its shape or design, if necessary, is made of resistant material, which may be plastic or any other material. Said piston (26) has at its right end a threaded region (27), in the central part (41) is smooth, and on the left side has two projections or guides (40) on each side of the piston (26), in the beginning of the left side has a circular part (42) coupled to the piston (26) of the same material, to which is coupled a rubber gasket (43) made of a material resistant to friction and abrasion of the liquids or gases. To install the piston (26) to the body mechanism (1), first threaded end (27) enter the pumping chamber (18), which was previously inserted the inner container (22), to enter and pass through holes (34 and 36), respectively, leaves the body of the piston (26), then passed through a hole with passed duct (30) located on the ergonomic handle (29) and subsequently will be coupled a metering screw (28), which depending on its position, allows that the piston (26), when driven scroll or slide a certain distance, which is directly proportional to the amount of product entering the mechanism; then pass through another hole with threaded pipe (25) located in the top of the primary support (6), the piston (26) is inserted into the threaded passage (25) being firmly and aligned within the pumping chamber (18) where the circular piece (42), together with the gasket (43), will encounter with the inner part of the inner container (22).

The ergonomic handle (29) will have a subject button (44), which will be at the top of the handle (29), inserted into a hole (45), the subject button (44) will have a system security is a metal tip or any material (38) and a slide fastener insurance (39), this security system in the handle (29) serves for the time of pumping and if you want the handle (29) is secured to the body of the pumping chamber (18), the metal tip (38) is housed in the recess (37) and thus the handle (29) has no movement, in addition to the guides (40) gives firmly and not allow the handle to move or rotate on its axis.

The supports (6) and (10), its role is to support the suction/discharge mechanism (1) by firmness in the pumping chamber (18) together with the piston (26), to be located in the extreme, totally eliminate any bending force on the seal (43), the mechanism (1) when loaded and manipulated the mechanism manually, using the ergonomic handle (29). Said supports (6 and 10) in the bottom (46) have a subject system similar to the male and female slide (47) or any other that can engage it, with this subject system will engage it a bridge (48), which in this description, is a passed tube, tubular in shape, with a light and strong design, has an inlet (89) and an outlet (66), a fastener (49) at its upper end, according to subject at fastening (47) and thereby to unite the supports (6, 10) of the mechanism body (1); said bridge (48) has the same along at least two parallel holes (50), and its only function is to reduce the body weight of the bridge (48), its location is strategic in order not to detract stiffness and strength, presents in its lower left and right ends, a fastener cavity (51, 52) in square shape, and each an oppressive piston (53) slides. Within the oppressive piston (53) are a fastener cavity (54) and a slot (55) for an oppressing nut (56). In fastener cavity (54) is housed an oppressive screw (57) which is fastened with the oppressing nut (56). The oppressor piston (53) is made of resistant material, can be plastic or PVC, and at its upper end (58) of a non-skid material; said oppressing piston (53) further has an additional clamping mean, which is an oppressive cam (59) of oppressing piston (53), which holds the oppressive piston (53) through an orifice (60), presenting the oppressive screw (57), when the oppressor piston (53) slides by the fastener cavities (51 and 52) and the oppressive cam of piston (59) engages the set screw (57) through hole (60) set screw (57); oppressive cam piston (59) is inserted into a cavity (61) of the fastener cavities (51 and 52) and turning this oppressive cam (59), this action set screw (57) rises and consequently screw up the oppressor piston (53), said oppressor piston subjects and press some attachments or items (21), these attachments, such as a pole, brush, roller handle extension, etc., at its end lower back have another squared fastener cavity (62) and for her the oppressive piston (53) slides, and in this oppressive piston, beside hold, its function is to retain and support a fastening mechanism (63) of the pump, which comprises: a T-shaped piece (64) having in its front part, at least two rectangular apertures (65), which have the function to be inserted in the outlet orifice (66) of the bridge (48) of the mechanism (1), where the fastener cavity (52), the oppressive piston (53) is inserted to perform the holding function; the T-shaped piece (64) has at its rear ends two holes (67), which house some securing means such as strap (68), whose function is to fasten the pump at user's body. The clamping mechanism (63) also has a further component which is a support (69) of the container (2) of the product, which, in the part that binds to the T-shaped piece (64); this likewise has a fastener (70). The support (69) of the product container, its only function is to allow adjusting the container (2) some degree angle to avoid spilling the product. This type of clamping mechanism is important for the operation of the pump of the present invention under which to develop certain types of activities as agricultural areas fumigation.

Another mode for attaching the container (2), of the pump of the present invention is that said container (2) is anchored in a fastening means (71) in the rear of the bridge (48), said means clamping (71) has a body which is divided into a circular attachment clamp (72), a right clamp body orifice (73), a circular gasket (74), a piece in the form of hook hole clamp including (75), a screw (76) and a nut (77). To shape the fastener (71) of the container (2), joined the straight body with the hole (73), with gasket (74), to the shaped part of the hook (75) through its orifice and insert the screw (76), which will hold it and will press with a nut (77), thereby forming the holding means with the clamp and hook (71), which join said parts provides such resistance to container (2), to effect prevent that this have movement. This embodiment of the pump of the present invention is for use when the weight of the container (2), is lighter and allows the user to work more freely.

Another modality for fasten the container (2), of the pump of the present invention is that the container is anchored in a fastening means (78) located in the rear of the bridge (48), said fastener (78) is very similar to the mode above it, since the top of the entire part of the body of the circular clamp fastening (72) with a straight grip body orifice (73) is used, the screw (76) and nut (77), and gasket (74); since this is coupled to the clamping means (78) which is formed of a rigid body and prolonged with a orifice on the upper end (90) which is coupled at its lower part to a curved semi-rigid metal tube (79), which has in its upper part a nozzle (81) with fastening means (82) where the hose (3) is coupled, and on its other lower end has a suction nozzle shaped punch (80), which at its tip has pointed teeth (83) that serve to perforate any material, preferably plastic or thin metal; the tube (79) through its punch tip (80) pierces any lid (84) of any container reuse, either a pot, a bottle, jug, etc. When the lid (84) plastic or metallic is pierced, a hole the same size as the metal tube (79) is formed, consequently the said tube (79) is inserted, the lid (84) is raised by the pipe (79), and then will engage a fastener called set screw (85) which is formed of a screw (86) which in its upper part has a cross channel (87) that runs through its central part, two small blades (88) arranged to each other, one on each end of the top of the screw (86) that serve to make holes in the plastic covers; an outgoing (91) surrounding the entire periphery of the screw, which will guide blades (88) when turning and cutting any plastic; a passed duct (92) passing through the center of the screw (86); a threaded region (93) and a millimeter passed channel (94) through the tip of the screw (86), later will couple it an oppressive nut with conical end (95), which get inside the screw (86) together with the metal tube (79); when placed at the desired distance, and will be tightened firmly beneath the lid (84) of the container (2) being suspended in the container. This embodiment of the pump of the present invention is to be used when the weight of the container is lightweight and recycled second hand as soda bottles, cans, jugs, containers etc., are used.

Another embodiment of the fastener of set screw is that is an oppressor tube (96), which has a passed duct with inlet and outlet (97), which runs through the center of the oppressor tube, and the side has another internally threaded duct not passed with inlet (98), which will insert a screw (99) that serve to tighten the tube (79), plus it serves as an anchor to the top, because when placing the cover (84) with the rigid tube (79) and the oppressor tube (96) beneath the lid, the container is closed, with the liquid, where it is suspended. This embodiment of the pump of the present invention is to be used when the weight of the container (2) is lighter and recycled second hand containers are used.

One embodiment of the bridge (48) of the pump, is that the composition is rigid to keep giving the necessary firmness in the first support (6) and second support (10), and having a metal line (100) or any other material; on its upper surface has fastening means (49) according to the needs of the mechanism body (1), which will engage in the bottom (46) of the primary supports (6) and secondary (10), by its clamping means (47); said bridge will have other fastening means may be any required form regardless of shape or design, but it can be adapted to the needs of the user, in this case is a pair of straps (101) that are engaged and secured to the body the metal line (100).

Having sufficiently described my invention, and this being a novelty, claim as my exclusive property, contained in the following clauses:

1. A suction and expulsion pumping device for pumping a fluid, comprising:

a handle located in an upper part of the pumping device, means for attachment and means for injection located in the upper part of the pumping device, at least one piston located in an interior of the pumping device and forming a wall of a pumping cavity, and at least one dispenser located at a rear end of the at least one piston, a valve body, including at least one inlet cavity and at least one outlet cavity, each of the at least one inlet and outlet cavities including a respective valve and nozzle, a pumping jacket located inside the pumping cavity, and a fastening means for fastening the pumping device to a source container for a fluid to be pumped.

2. The suction and expulsion pumping device of claim 1, wherein the pumping device is manually actuated for the suction and expulsion of the fluid to be pumped, wherein the fluid to be pumped may be either liquid or gas.

3. The suction and expulsion pumping device of claim 1, wherein the at least one piston is a single cylindrical piece made of a resistant material and has a threaded area at a first end, a smooth central part, and two projections at a second end opposite the first end, the projections positioned to keep the handle from turning, and a gasket provided on the at least one piston made of a material resistant to friction and abrasion.

4. The suction and expulsion pumping device of claim 3, further comprising a dosing nut and distance limiter for the handle, the dosing nut and distance limiter fitting into the threaded area of the at least one piston, the dosing nut and distance limiter limiting the stroke of the at least one piston to dose an amount of fluid to be pumped with each stroke of the at least one piston.

5. The suction and expulsion pumping device of claim 1, further comprising a valve body including an inlet nozzle and an outlet nozzle fluidly connected to the pumping cavity;

a plurality of retaining projections provided on the outside of the pumping cavity to hold a hose in place, the hose provided for transferring a fluid to be pumped to or from the pump cavity;

an inlet cavity and an outlet cavity formed in the valve body for receiving pressure responsive one-way valve elements.

6. The suction and expulsion pumping device of claim 5, wherein the valve elements are of the diaphragm, duckbill, or pellet type.

7. The suction and expulsion pumping device of claim 1, wherein the jacket is a tubular piece and has an external circular projection at a first end of the jacket, and an internal circular projection at a second end opposite the first end of the jacket, and the jacket includes two channels running from the first end to the second end, wherein the at least one piston is provided in the channels.

8. The suction and expulsion pumping device of claim 7, wherein the jacket is inserted into the pumping cavity and the jacket and pumping cavity are joined by a union nut.

9. The suction and expulsion pumping device of claim 8, wherein the pumping cavity is cylindrical, with a smooth interior surface and the jacket is received within the cylindrical pumping cavity, wherein two circular internal projections are formed in the pumping cavity that correspond to the channels to limit the stroke length of the at least one piston, and wherein the union nut is threaded on the outside of the pumping cavity to provide a seal to prevent leakage of fluid, wherein a projection is attached to the outside of the pumping cavity to form a secondary piston support for the at least one piston.

10. The suction and expulsion pumping device of claim 9, wherein the secondary piston support includes a hose duct, and a pressure cam provided in a cam orifice formed in the secondary support, the pressure cam holding a hose that transports fluid from the source container to the pumping cavity, wherein the secondary piston support includes a clamping system to attach the pumping cavity to a pump chassis.

11. The suction and expulsion pumping device of claim 10, wherein a primary piston support is provided that includes a through hole through which the threaded area of the at least one piston is introduced, and the hose is detachably affixed to the primary piston support through a hose duct, the pressure cam pressing the hose into the hose duct.

12. The suction and expulsion pumping device of claim 11, wherein the primary and secondary piston supports act together to eliminate any lateral force on the pumping device, prevent leakage through the gasket when the pumping device is manually handled.

13. The suction and expulsion pumping device of claim 12, wherein the pump chassis is tubular with two parallel recesses within the chassis to reduce weight, the chassis including inlet and outlet holes, with both the primary and secondary piston supports attached to the chassis via clamping systems, wherein the clamping systems include a square cavity for receiving a square piston and a square screw with a square nut tightened to attach the chassis to the primary and secondary piston supports.

14. The suction and expulsion pumping device of claim 1, wherein the means for attachment are selected from: a pole, an extension, a roller handle, and a brush.

15. The suction and expulsion pumping device of claim 1, wherein the fastening means for fastening the pumping device to the source container includes a hook with a retaining hole for connecting to a projecting screw and tightened with a nut.

16. The suction and expulsion pumping device of claim 1, wherein the fluid to be pumped is suctioned by a rigid and semi-curved metallic tube having a discharge nozzle and the fastening means includes a suction nozzle that is connected to a screw which includes a transverse channel that runs through a central part of the screw, two protrusions at the top of the screw, and a threaded area surrounding the exterior of the screw to be fitted to a nut fitted with a conical end to place the nozzle at a desired distance and can be used to perforate and secure a lid of the source container.

17. The suction and expulsion pumping device of claim 1, wherein the fastening means includes a tube with a duct that runs through the central part of the tube and has a threaded conduit with a screw inserted therein to anchor a lid of the source container, such that some fluid is suspended in the body of the pump.

18. The suction and expulsion pumping device of claim 10, wherein the pump chassis is rigid and includes a pair of straps that are coupled and fastened to a rod formed on the pump chassis.

* * * * *